US008784183B2

(12) United States Patent
Nicely

(10) Patent No.: US 8,784,183 B2
(45) Date of Patent: Jul. 22, 2014

(54) GAMING SYSTEM, GAMING DEVICE, AND METHOD FOR DISPLAYING INDICATIONS OF AWARDS THAT COULD HAVE BEEN WON

(75) Inventor: Mark C. Nicely, Daly City, CA (US)

(73) Assignee: IGT, Las Vegas, NV (US)

( * ) Notice: Subject to any disclaimer, the term of this patent is extended or adjusted under 35 U.S.C. 154(b) by 296 days.

(21) Appl. No.: 13/246,422

(22) Filed: Sep. 27, 2011

(65) Prior Publication Data

US 2013/0079097 A1 Mar. 28, 2013

(51) Int. Cl.
*G07F 17/32* (2006.01)

(52) U.S. Cl.
USPC ..... 463/20; 463/22; 463/29

(58) Field of Classification Search
CPC ..... G07F 17/32; G07F 17/34; G07F 17/323; G07F 17/3244; G07F 17/3241
USPC ..... 463/20, 22, 29, 16
See application file for complete search history.

(56) References Cited

U.S. PATENT DOCUMENTS

| | | | |
|---|---|---|---|
| 4,448,419 | A | 5/1984 | Telnaes |
| 4,880,237 | A | 11/1989 | Kishishita |
| 5,127,651 | A | 7/1992 | Okada |
| 5,197,736 | A | 3/1993 | Backus |
| 5,702,303 | A | 12/1997 | Takemoto et al. |
| 5,766,074 | A | 6/1998 | Cannon et al. |
| 5,851,148 | A | 12/1998 | Brune et al. |
| 5,857,909 | A | 1/1999 | Rubin |
| 5,871,400 | A | 2/1999 | Yfantis |
| 6,001,016 | A | 12/1999 | Walker et al. |
| 6,012,983 | A | 1/2000 | Walker et al. |
| 6,068,552 | A | 5/2000 | Walker et al. |
| 6,120,031 | A | 9/2000 | Adams |
| 6,190,255 | B1 | 2/2001 | Thomas et al. |
| 6,206,782 | B1 | 3/2001 | Walker et al. |
| 6,287,194 | B1 | 9/2001 | Okada et al. |
| 6,299,531 | B1 | 10/2001 | Bommarito |
| 6,309,300 | B1 | 10/2001 | Glavich |
| 6,315,664 | B1 | 11/2001 | Baerlocher et al. |
| 6,319,124 | B1 | 11/2001 | Baerlocher et al. |
| 6,364,313 | B1 | 4/2002 | Moody |
| 6,364,767 | B1 | 4/2002 | Brossard et al. |

(Continued)

OTHER PUBLICATIONS

Don't Sweat the RNG; Tip of the Month; www.casinocenter.com; Sep. 2003; p. 48 (1 page).

(Continued)

*Primary Examiner* — Pierre E Elisca
(74) *Attorney, Agent, or Firm* — Neal, Gerber & Eisenberg LLP

(57) ABSTRACT

A gaming system, gaming device, and method which provide a display of one or more missed awards based on one or more numbers generated by a random number generator ("RNG") for possible use in determining a randomly generated outcome for a play of a game, but which are not used to determine any outcome for the play of the game. The unused or unemployed RNG numbers: (a) may be the numbers generated by the RNG before the numbers which are actually used or employed for that play of the game (i.e., the employed numbers); (b) may be the numbers generated by the RNG after the numbers which are used or employed for that play of the game; or (c) if no plays of the game are occurring, the numbers unused numbers generated by the RNG at one or more points in time.

20 Claims, 13 Drawing Sheets

(56) References Cited

U.S. PATENT DOCUMENTS

| | | | |
|---|---|---|---|
| 6,416,406 | B1 | 7/2002 | Duhamel |
| 6,439,995 | B1 | 8/2002 | Hughs-baird et al. |
| 6,450,883 | B1 | 9/2002 | O'halloran |
| 6,511,375 | B1 | 1/2003 | Kaminkow |
| 6,514,141 | B1 | 2/2003 | Kaminkow et al. |
| 6,558,254 | B2 | 5/2003 | Baelocher et al. |
| 6,595,854 | B2 | 7/2003 | Hughs-baird et al. |
| 6,599,185 | B1 | 7/2003 | Kaminkow et al. |
| 6,620,044 | B1 | 9/2003 | Okada |
| 6,676,516 | B2 | 1/2004 | Baerlocher et al. |
| 6,692,356 | B2 | 2/2004 | Baerlocher et al. |
| 6,722,981 | B2 | 4/2004 | Kaminkow et al. |
| 6,746,328 | B2 | 6/2004 | Cannon et al. |
| 6,783,457 | B2 | 8/2004 | Hughs-baird et al. |
| 6,875,108 | B1 | 4/2005 | Hughs-baird |
| 6,913,262 | B2 | 7/2005 | Berman |
| 6,932,701 | B2 | 8/2005 | Glavich et al. |
| 7,112,137 | B2 | 9/2006 | Baerlocher et al. |
| 7,182,689 | B2 | 2/2007 | Hughs-baird et al. |
| 7,273,415 | B2 | 9/2007 | Cregan et al. |
| 7,303,469 | B2 | 12/2007 | Kaminkow |
| 7,311,598 | B2 | 12/2007 | Kaminkow et al. |
| 7,393,278 | B2 | 7/2008 | Gerson et al. |
| 7,572,183 | B2 | 8/2009 | Olivas et al. |
| 7,585,222 | B2 | 9/2009 | Muir |
| 7,695,358 | B2 | 4/2010 | Walker et al. |
| 7,713,123 | B2 | 5/2010 | Gerson et al. |
| 7,744,453 | B2 | 6/2010 | Pacey |
| 7,993,195 | B2 | 8/2011 | Belger et al. |
| 2003/0224847 | A1 | 12/2003 | Jaimet |
| 2003/0224852 | A1 | 12/2003 | Walker et al. |
| 2003/0228902 | A1 | 12/2003 | Walker et al. |
| 2004/0053657 | A1 | 3/2004 | Fiden et al. |
| 2004/0224748 | A1 | 11/2004 | Cannon et al. |
| 2005/0054435 | A1 | 3/2005 | Rodgers et al. |
| 2006/0148551 | A1 | 7/2006 | Walker et al. |
| 2007/0015566 | A1 | 1/2007 | Baerlocher et al. |
| 2007/0060271 | A1 | 3/2007 | Cregan et al. |
| 2007/0298872 | A1* | 12/2007 | Gerrard et al. ..... 463/25 |
| 2008/0004105 | A1 | 1/2008 | Cregan et al. |
| 2008/0268935 | A1 | 10/2008 | Acres |
| 2008/0268953 | A1 | 10/2008 | Acres |
| 2009/0069073 | A1 | 3/2009 | Gerrard et al. |
| 2010/0222130 | A1 | 9/2010 | Pacey |
| 2011/0136565 | A1* | 6/2011 | Low ..... 463/20 |

OTHER PUBLICATIONS

How do slot machines and other electronic gambling machines actually work?, Journal of Gambling Issues, Issue 11, Jul. 2004 (41 pages).

* cited by examiner

GAMING SYSTEM, GAMING DEVICE, AND METHOD FOR DISPLAYING INDICATIONS OF AWARDS THAT COULD HAVE BEEN WON

COPYRIGHT NOTICE

A portion of the disclosure of this patent document contains material which is subject to copyright protection. The copyright owner has no objection to the photocopy reproduction of the patent document or the patent disclosure in exactly the form it appears in the Patent and Trademark Office patent file or records, but otherwise reserves all copyright rights whatsoever.

BACKGROUND

Gaming devices which provide players awards in primary or base games are well known. Gaming devices generally require the player to place or make a wager to activate the primary or base game. In many of these gaming devices, the award is based on the player obtaining a winning symbol or symbol combination and on the amount of the wager (e.g., the higher the wager, the higher the award). Symbols or symbol combinations which are less likely to occur usually provide higher awards.

In such known gaming devices, typically, the amount of the wager made on the primary game by the player may vary. For instance, the gaming device may enable the player to wager a minimum number of credits, such as one credit (e.g., one penny, nickel, dime, quarter or dollar), up to a maximum number of credits, such as five credits. This wager may be made by the player a single time or multiple times in a single play of the primary game. For instance, a slot game may have one or more paylines and the slot game may enable the player to make a wager on each payline in a single play of the primary game. Thus, it is known that a gaming device, such as a slot gaming device, may enable players to make wagers of substantially different amounts on each play of the primary or base game ranging, for example, from 1 credit up to 125 credits (e.g., 5 credits on each of 25 separate paylines). Accordingly, it should be appreciated that different players play at substantially different wagering amounts or levels and at substantially different rates of play.

While players generally understand the various wagering aspects of gaming devices and generally understand that the outcomes are randomly generated, many players do not understand exactly how various gaming devices actually generate the random numbers or how various gaming devices use the randomly generated numbers to generate and display symbols and any awards associated with winning symbols or combinations of the symbols.

Various known gaming devices such as various slot gaming devices include a pseudo-random number generator ("pRNG"). The pRNG uses software to generate a series of outcomes in what appears to be a random pattern, insofar as this series of outcomes satisfies established mathematical tests for unpredictability and randomness. The technical designation of "pseudo" in pseudo-random number generator indicates that the outcome generation follows an exact sequence relative to the starting state (often referred to as a seed) and the algorithm employed to generate the next outcome based on the current pRNG state. However, an effective algorithm, such as a Marsaglia generator, a Mersenne Twister, or the method described in U.S. Pat. No. 5,871,400 to Yfantis, produces a series of outcomes that cannot be predicted without knowledge of the algorithm and state. Similarly, an effective algorithm has a very long cycle length until the sequence of numbers repeats. That is, the cycle length is long enough to make pattern matching impractical. Finally, the most effective application of pRNG algorithms will continually burn through or "eat" outcomes while waiting for a request by the application for a random outcome. Thus, regulated pRNG algorithms in slot machines typically step through outcomes between new games launched by a player.

Almost all of the pRNG generated numbers are not used to determine outcomes of plays of the game of the gaming device. When a player of the gaming device presses or activates the appropriate play button, the processor of the gaming device obtains a series of the next numbers generated by the pRNG. In other words, the series or string of generated numbers right as or right after (i.e., the millisecond) the play button is activated is obtained and used to determine which symbols will be displayed by each reel. In many known slot gaming devices, the selected generated numbers are used to determine numbers on virtual reels which are associated with specific symbols on the mechanical reels or video reels of the slot gaming device. This well known and widely commercially implemented process is explained in U.S. Pat. No. 4,448,419 to Telnaes. For example, in a five reel slot machine, as or right after the play button is activated, the next five generated numbers are obtained from the pRNG and respectively used to determine where to stop each of the reels (i.e., each of the five numbers is used for a different one of the five reels to determine the symbol or symbols on that reel to display).

Accordingly, for each play of the slot game, the outcome or symbols displayed by each of the reels, which is based on the numbers obtained from the pRNG, depend on the exact millisecond when the play button is activated. If the play button is activated earlier or later for any play of the slot game (i.e., even by a millisecond earlier or later), different numbers are used to determine the symbols generated by the reels for that play of the game, and thus the outcome or symbols generated for that play of the slot game will be will likely be different. Even if the player continuously activates the play button as fast as humanly possible, as mentioned above, the pRNG generates so many numbers so quickly that only a very small amount of the pRNG generated numbers are actually used to determine actual outcomes for the plays of the game.

This multi-layer configuration is part of the how gaming devices protect against cheating. More specifically, if the same numbers are always input into the pRNG, the pRNG will always generate the same numbers in the same order. Thus, if a player knew the algorithm, state, and any external variables (e.g., time of day) used in the algorithm, the player could technically calculate each of the generated numbers and determine the symbols which will be generated using those numbers, and thus outcomes. However, even if the player knows this information, the player does not know how many random numbers were generated from one activation of the play button to the next activation of the play button, and it is practically impossible for a player to activate the play button at a beneficial time.

When treated as a black box whose inner workings are not known, a pRNG can be, and in the gaming industry usually is, referred to simply as a random number generator ("RNG"). There is, however, an important distinction between a pRNG and an RNG because electro-mechanical devices exist that can produce a random stream of outcomes without employing a pRNG. For example, the time delay between alpha particle emissions from a radioactive material is random. Devices exist to measure this delay and generate random bit streams therefrom without utilizing pRNG algorithms. Such devices are referred to as a "true RNG" or simply "RNG." However, the present disclosure contemplates employing any type of pRNG or RNG irrespective of how that pRNG or RNG is implemented and irrespective of the fact that modern slot machines primarily if not exclusive rely on a pRNG implementation. Thus, a pRNG and an RNG are referred to interchangeably herein.

Certain known gaming devices or systems display visual game play histories of previous outcomes or wins and losses (or possibly only wins) for a designated quantity of previous plays of the game, such as by: (a) displaying the results numerically; (b) using a bar graph where the height of the bar indicated the award value (with the amount shown numerically at the top of at least some of the taller bars); and (c) displaying text-based and/or graphics-based depiction of each prior outcome, especially for games played online or via mobile devices.

Certain other known gaming devices configured to operate a selection game display awards that are associated with unpicked selections and that are not provided to a player. One of these gaming devices displays a plurality of selections, each of which is associated with an award, to a player. Each of the awards is masked such that the player does not know the award associated with any of the selections. The gaming device enables the player to pick a predetermined quantity of the selections, reveals the award associated with each picked selection, and provides the revealed award to the player. After the player has picked the predetermined quantity of selections, the gaming device reveals the award associated with each unpicked selection.

Certain other known gaming devices display an attract mode when not being played by a player. The attract mode is configured to attract players to the gaming devices and to encourage players to play the gaming devices. In one of these gaming devices, while the attract mode is being implemented the gaming device displays one or more predetermined plays of one or more games resulting in one or more predetermined outcomes.

However, no known gaming devices display any indication of the numbers which are generated by the RNG but which are not used for plays of the game. In other words, known gaming machines do not use the numbers generated by the RNG that would have been used if the player would have activated the play button one or more microseconds faster or slower to display any indication of the outcomes or associated awards that would have been generated if the player activated the play button sooner or later. Also, no known gaming devices display what symbols or outcomes would have occurred had the player activated the play button at a time prior to or after the player does so, such as at an exact right time to win a jackpot award.

Thus, there is a continuing need to provide new and different gaming devices and gaming systems as well as new and different ways to display awards provided to players or awards which could have been provided to players of those gaming devices and gaming systems in order to: (a) help players see and understand that outcomes are being generated continuously and thus not based on prior outcomes or other unfair mechanisms, as many players mistakenly believe; (b) provide players a greater sense of the potential outcome distribution available from one or more games without playing those games a large number of times; and (c) provide players who enjoy trying to take advantage of machine patterns that they believe they can detect, who are sometimes referred to as "pattern players," a new mode of play.

SUMMARY

Various embodiments of the present disclosure provide a gaming system, gaming device, and method which provide a display of an award based, at least in part, on one or more numbers generated by a random number generator ("RNG") or pseudo-random number generator ("pRNG") for possible use in determining a randomly generated outcome for a play of a game, but which are not used to determine any outcome for the play of the game. For brevity, the numbers generated by the RNG for possible use in determining the randomly generated outcome for the play of the game, but which are not used to determine the randomly generated outcome for the play of the game, are sometimes referred to herein as unused RNG numbers or unemployed RNG numbers. Additionally, for brevity, the numbers generated by the RNG which are actually used for a play of the game are sometimes referred to herein as used RNG numbers or employed RNG numbers. For a play of the game, the unused or unemployed RNG numbers: (a) may be the numbers generated by the RNG before the numbers which are actually used or employed for that play of the game (i.e., the employed numbers); (b) may be the numbers generated by the RNG after the numbers which are used or employed for that play of the game; or (c) if no plays of the game are occurring, the numbers generated by the RNG at one or more points in time. For brevity, the awards that would have been generated in the play of the game based on unused RNG numbers are referred to herein as missed awards.

In certain embodiments, the display provided by the gaming system, gaming device, and method of the present disclosure essentially informs the player that if the player would have activated the play button at a different time (such as right before or right after the player did so), the player could have won an award equal to the displayed award or within the range of the displayed award value tier. In other embodiments, the display informs the player of one or more awards that would have been won if the player activated the play button respectively at one or more points in time. It should be appreciated that the present disclosure contemplates that multiple different displays can be employed for representing missed awards based on one or more unused RNG numbers.

In various embodiments, the gaming system or gaming device displays each missed award to the player separately or in a separate display from where the gaming system or gaming device displays any actual awards for plays of the game to the player to avoid any confusion of what awards are actually won by the player. In other words, the gaming system or gaming device clearly indicates to the player that the player could have won, but did not win, each missed award.

In various embodiments, the gaming system or gaming device displays each or each of a plurality of the unused outcomes to the player including, non-pay outcomes (i.e., awards having value equal to zero). In other words, the gaming system or gaming device clearly indicates to the player the frequency at which outcomes are generated.

In various embodiments, the gaming system or gaming device displays more than one missed award. In various embodiments, the gaming system or gaming devices displays: (a) one missed award after one or more designated plays of the game; (b) one missed award after each play of the game; (c) multiple missed awards after each designated play of the game; or (d) multiple missed awards after each play of the game. It should further be appreciated that the gaming system or gaming device could display missed awards based on one or more unused RNG numbers when the gaming system or gaming device is not being played by a player. By being able to see one, a plurality, or all of the missed awards based on one or more unused RNG numbers, certain players may be more likely to play the gaming system or gaming device.

In various other embodiments, the display based on the unused RNG numbers can be: (a) a suitable indication or representation of certain unused RNG numbers; (b) a suitable indication or representation of the potential value of certain unused RNG numbers; (c) a display of one or more symbols which would have been generated in the play of the game based on certain unused RNG numbers; or (d) a display of one or more outcomes (e.g., groups of symbols) which would have been generated in the play of the game based on certain unused RNG numbers. In such alternative embodiments, it should be appreciated that the present disclosure contemplates that multiple different displays can be employed for the potential values of the unused RNG numbers, the symbols based on these unused RNG numbers, the outcomes or groups of symbols based on these unused RNG numbers, and the awards based on these unused RNG numbers.

Additional features and advantages are described in, and will be apparent from, the following Detailed Description and the figures.

DETAILED DESCRIPTION

The present disclosure may be implemented in various configurations for gaming machines, gaming devices, or gaming systems, including but not limited to: (1) a dedicated gaming machine, gaming device, or gaming system wherein the computerized instructions for controlling any games (which are provided by the gaming machine or gaming device) are provided with the gaming machine or gaming device prior to delivery to a gaming establishment; and (2) a changeable gaming machine, gaming device, or gaming system wherein the computerized instructions for controlling any games (which are provided by the gaming machine or gaming device) are downloadable to the gaming machine or gaming device through a data network after the gaming machine or gaming device is in a gaming establishment. In one embodiment, the computerized instructions for controlling any games are executed by at least one central server, central controller, or remote host. In such a 'thin client' embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller, or remote host to a gaming device local processor and memory devices. In such a 'thick client' embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
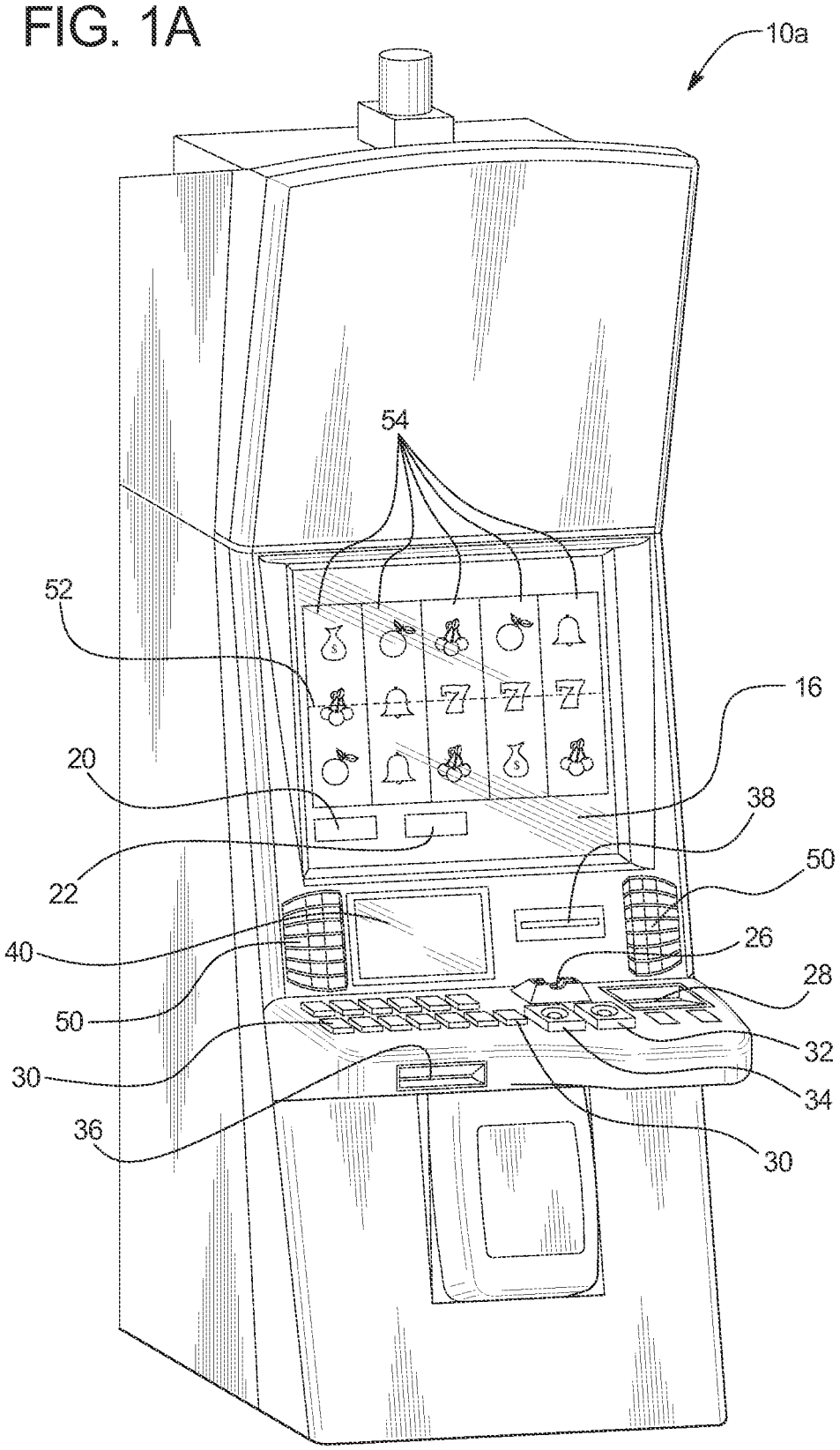
FIGS. 1A and 1B are perspective views of example alternative embodiments of the gaming device of the present disclosure.
Figure 1B:
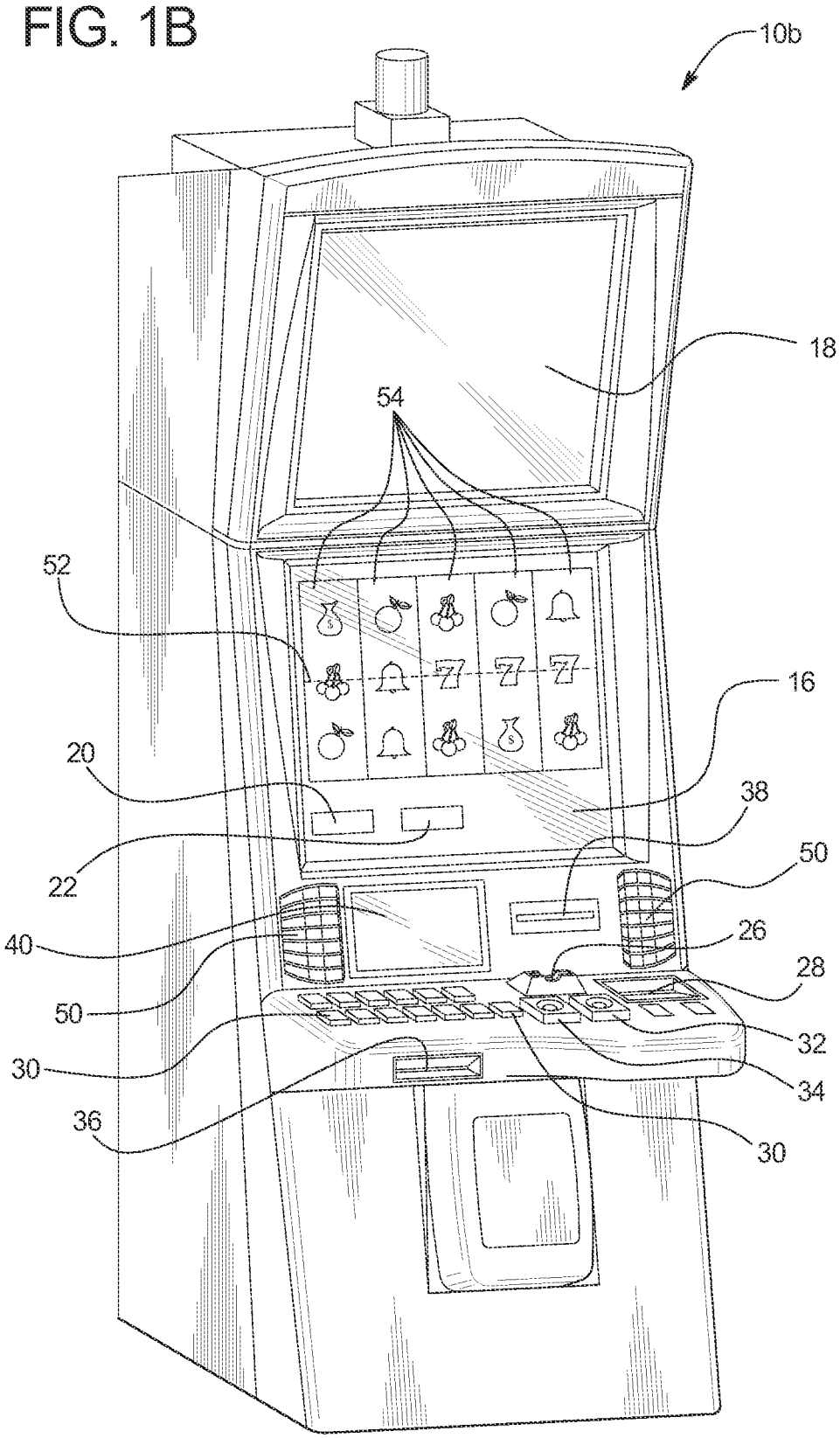

Referring now to the drawings, two example alternative embodiments of a gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing, or cabinet which provides support for a plurality of displays, inputs, controls, and other features of a conventional gaming machine. It is configured so that a player can operate it while standing or sitting. The gaming device can be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
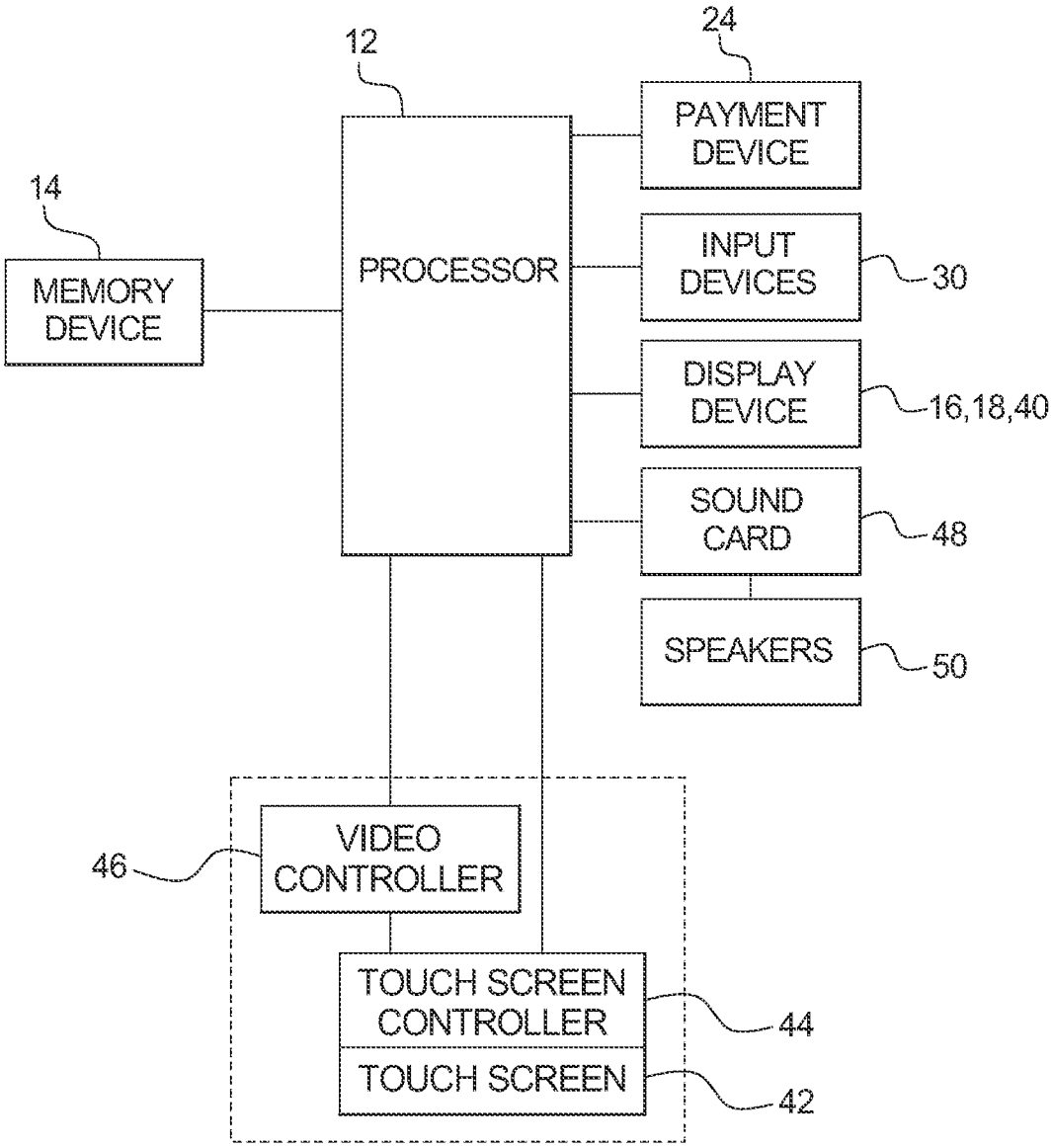
FIG. 2A is a schematic block diagram of one embodiment of an electronic configuration for one of the gaming devices disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information, and applicable game rules that relate to the play of the gaming device. In one embodiment, the memory device includes random access memory (RAM), which can include non-volatile RAM (NVRAM), magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD, or USB memory device. In other embodiments, part or all of the program code and/or operating data described above can be downloaded to the memory device through a suitable network.

In one embodiment, an operator or a player can use such a removable memory device in a desktop computer, a laptop computer, a hand-held device, such as a personal digital assistant (PDA), a portable computing or mobile device, or another computerized platform to implement the present disclosure. In one embodiment, the gaming device or gaming machine disclosed herein is operable over a wireless network, for example as part of a wireless gaming system. In one such embodiment, the gaming machine may be a hand-held device, a mobile device, or any other suitable wireless device that enables a player to play any suitable game at a variety of different locations. In various embodiments in which the gaming device or gaming machine is a hand-held device, a mobile device, or any other suitable wireless device, at least one memory device and at least one processor which control the game or other operations of the hand-held device, mobile device, or other suitable wireless device may be located: (a) at the hand-held device, mobile device or other suitable wireless device; (b) at a central server or central controller; or (c) any suitable combination of the central server or central controller and the hand-held device, mobile device or other suitable wireless device. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a 'computer' or 'controller.'

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted on the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance, or the equivalent. In one embodiment, the gaming device includes a bet display 22 which displays a player's amount wagered. In one embodiment, as described in more detail below, the gaming device includes a player tracking display 40 which displays information regarding a player's play tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels, or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket, or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip, a coded magnetic strip or coded rewritable magnetic strip, wherein the programmed microchip or magnetic strips are coded with a player's identification, credit totals (or related data), and/or other relevant information. In another embodiment, a player may carry a portable device, such as a cell phone, a radio frequency identification tag, or any other suitable wireless device, which communicates a player's identification, credit totals (or related data), and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B, and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button, or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card or smart card, may be implemented in accordance with the gaming device disclosed herein.

In one embodiment, as mentioned above and as seen in FIG. 2A, one input device is a touch-screen 42 coupled with a touch-screen controller 44 or some other touch-sensitive display overlay to allow for player interaction with the images on the display. The touch-screen and the touch-screen controller are connected to a video controller 46. A player can make decisions and input signals into the gaming device by touching the touch-screen at the appropriate locations. One such input device is a conventional touch-screen button panel.

The gaming device may further include a plurality of communication ports for enabling communication of the processor with external peripherals, such as external video sources, expansion buses, game or other displays, a SCSI port, or a keypad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as by playing music for the primary and/or secondary game or by playing music for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera, in communication with the processor (and possibly controlled by the processor), that is selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera as well as to display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering game as the primary or base game. The gaming machine or device may include some or all of the features of conventional gaming machines or devices. The primary or base game may comprise any suitable reel-type game, card game, cascading or falling symbol game, number game, or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented. In one embodiment, the disclosed multi-dimensional cascading symbol game is implemented as a base or primary game.

In one embodiment, as illustrated in FIGS. 1A and 1B, a base or primary game may be a slot game with one or more paylines 52. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, displays the plurality of simulated video reels 54. Each reel 54 displays a plurality of indicia or symbols, such as bells, hearts, fruits, numbers, letters, bars, or other images which preferably correspond to a theme associated with the gaming device. In another embodiment, one or more of the reels are independent reels or unisymbol reels. In this embodiment, each independent or unisymbol reel generates and displays one symbol to the player.

In one embodiment, one or more of the paylines may be horizontal, vertical, circular, diagonal, angled or any combination thereof. In another embodiment, one or more of the paylines each include a plurality of adjacent symbol display positions on a requisite number of adjacent reels. In one such embodiment, one or more paylines are formed between at least two symbol display positions which are adjacent to each other by either sharing a common side or sharing a common corner (i.e., such paylines are connected paylines). In these embodiments, the gaming device enables a player to wager on one or more of such paylines to activate such wagered on paylines.

In another embodiment wherein one or more paylines are formed between at least two symbol display positions which are adjacent to each other, the gaming device enables a player to wager on and thus activate a plurality of symbol display positions. In this embodiment, one or more paylines which are formed from a plurality of adjacent active symbol display positions on a requisite number of adjacent reels are activated.

In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol display positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device that enables wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol display positions on a first reel by the number of symbols generated in active symbol display positions on a second reel by the number of symbols generated in active symbol display positions on a third reel and so on for each reel of the gaming device with at least one symbol generated in an active symbol display position. For example, a three reel gaming device with three symbols generated in active symbol display positions on each reel includes 27 ways to win (i.e., 3 symbols on the first reel×3 symbols on the second reel×3 symbols on the third reel). A four reel gaming device with three symbols generated in active symbol display positions on each reel includes 81 ways to win (i.e., 3 symbols on the first reel×3 symbols on the second reel×3 symbols on the third reel×3 symbols on the fourth reel). A five reel gaming device with three symbols generated in active symbol display positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol display positions by one or more of the reels modifies the number of ways to win.

In another embodiment, the gaming device enables a player to wager on and thus activate symbol display positions. In one such embodiment, the symbol display positions are on the reels. In this embodiment, if based on the player's wager, a reel is activated, then each of the symbol display positions of that reel will be activated and each of the active symbol display positions will be part of one or more of the ways to win. In one embodiment, if based on the player's wager, a reel is not activated, then a designated number of default symbol display positions, such as a single symbol display position of the middle row of the reel, will be activated and the default symbol display position(s) will be part of one or more of the ways to win. This type of gaming machine enables a player to wager on one, more than one or all of the reels and the processor of the gaming device uses the number of wagered on reels to determine the active symbol display positions and the number of possible ways to win. In alternative embodiments, (1) no symbols are displayed as generated at any of the inactive symbol display positions, or (2) any symbols generated at any inactive symbol display positions may be displayed to the player but suitably shaded or otherwise designated as inactive.

In one embodiment wherein a player wagers on one or more reels, a player's wager of one credit may activate each of the three symbol display positions on a first reel, wherein one default symbol display position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol display positions on a first reel, each of the three symbol display positions on a second reel and each of the three symbol display positions on a third reel wherein one default symbol display position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol display position on a first reel forms part of a winning symbol combination with or is otherwise suitably related to a symbol generated in an active symbol display position on a second reel. In this embodiment, the gaming device classifies each pair of symbols which form part of a winning symbol combination (i.e., each pair of related symbols) as a string of related symbols. For example, if active symbol display positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of two cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol display positions (i.e., as opposed to a quantity of awards being based on how many paylines that would have passed through each of the strings of related symbols in active symbol display positions).

In one embodiment, a base or primary game may be a poker game wherein the gaming device enables the player to play a conventional game of video draw poker and initially deals five cards all face up from a virtual deck of fifty-two cards. Cards may be dealt as in a traditional game of cards or in the case of the gaming device, the cards may be randomly selected from a predetermined number of cards. If the player wishes to draw, the player selects the cards to hold via one or more input devices, such as by pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the number of credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand against a payout table and awards are provided to the player.

In one embodiment, a base or primary game may be a keno game wherein the gaming device displays a plurality of selectable indicia or numbers on at least one of the display devices. In this embodiment, the player selects at least one bit potentially a plurality of the selectable indicia or numbers via an input device such as a touch screen. The gaming device then displays a series of drawn numbers and determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or in a bonus or secondary round. In one embodiment, the disclosed multi-dimensional cascading symbol game is implemented as a bonus or secondary game. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game, and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition occurs based on exceeding a certain amount of game play (such as number of games, number of credits, amount of time), or reaching a specified number of points earned during game play.

In another embodiment, the gaming device processor 12 or central controller 56 randomly provides the player one or more plays of one or more secondary games. In one such embodiment, the gaming device does not provide any apparent reason to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a 'bonus meter' programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy-in for a bonus game is needed. That is, a player may not purchase entry into a bonus game; rather they must win or earn entry through play of the primary game, thus encouraging play of the primary game. In another embodiment, qualification of the bonus or secondary game is accomplished through a simple 'buy-in' by the player—for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
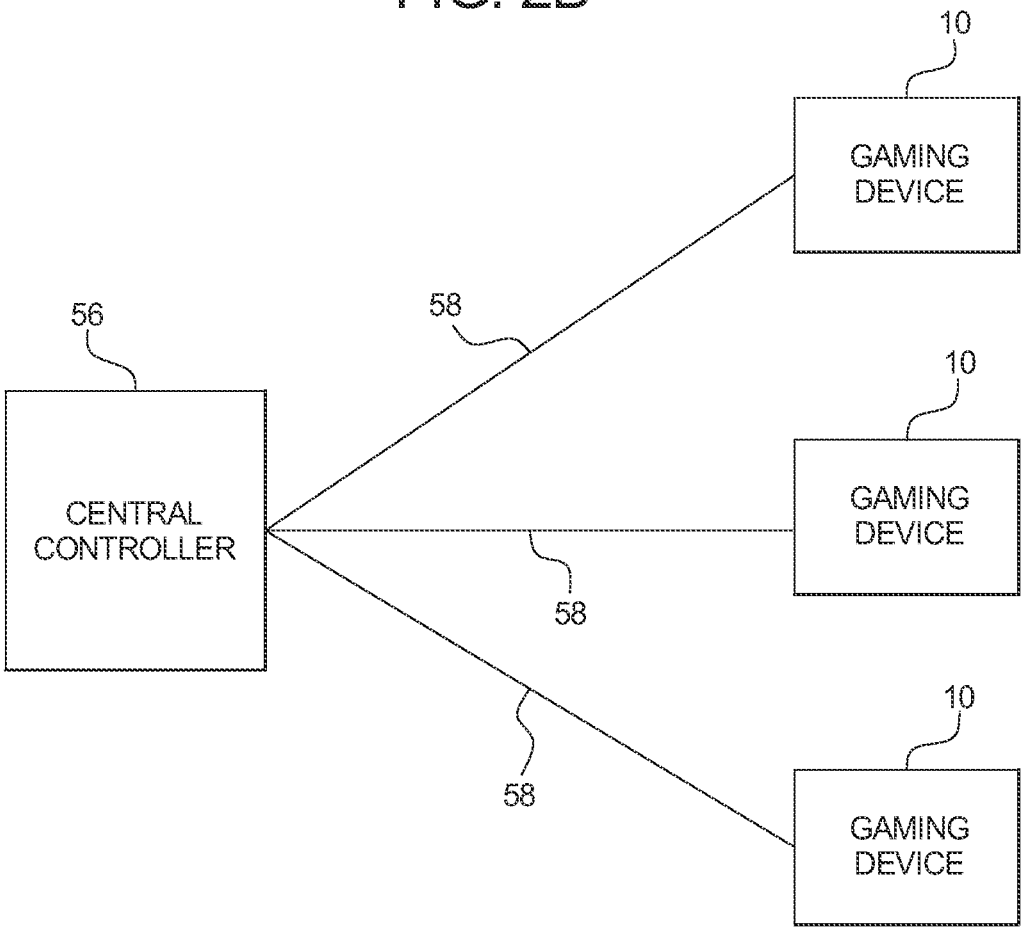
FIG. 2B is a schematic block diagram of one embodiment of a network configuration for a plurality of gaming devices disclosed herein.

In one embodiment, as illustrated in FIG. 2B, one or more of the gaming devices 10 are in communication with each other and/or at least one central controller 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands, or any other suitable data or signal between the individual gaming device and the central server. The gaming device processor is operable to execute such communicated events, messages, or commands in conjunction with the operation of the gaming device. Moreover, the processor of the central server is designed to transmit and receive events, messages, commands, or any other suitable data or signal between the central server and each of the individual gaming devices. The central server processor is operable to execute such communicated events, messages, or commands in conjunction with the operation of the central server. It should be appreciated that one, more or each of the functions of the central controller, central server or remote host as disclosed herein may be performed by one or more gaming device processors. It should be further appreciated that one, more or each of the functions of one or more gaming device processors as disclosed herein may be performed by the central controller, central server or remote host. In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility, and the like.

In another embodiment, a predetermined game outcome value is determined for each of a plurality of linked or networked gaming devices based on the results of a bingo, keno, or lottery game. In this embodiment, each individual gaming device utilizes one or more bingo, keno, or lottery games to determine the predetermined game outcome value provided to the player for the interactive game played at that gaming device. In one embodiment, the bingo, keno, or lottery game is displayed to the player. In another embodiment, the bingo, keno or lottery game is not displayed to the player, but the results of the bingo, keno, or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card with each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game, and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of whether the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any player's gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be achieved by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Display of Missed Awards Based on One or More Unused RNG Numbers

In various embodiments, the gaming system and gaming device of the present disclosure includes a number generator (such as a random number generator ("RNG") or pseudo-random number generator ("pRNG")) which is configured to regularly, continuously, or otherwise generate numbers which are referred to herein as RNG numbers as explained above. As also explained above, the RNG rapidly generates RNG numbers (such as hundreds or thousands of RNG numbers per second) whether or not a player is playing the gaming system or gaming device. Almost all of these generated RNG numbers are not used to determine actual outcomes of plays of the game(s) of the gaming system or gaming device, as also explained above. The gaming system or gaming device of the present disclosure displays one or more missed awards that would have been won if certain of the unused or unemployed RNG numbers would have been employed for one or more plays of the game of the gaming system or gaming device. The unused or unemployed RNG numbers: (a) may be the numbers generated by the RNG before the numbers which are actually used or employed for an actual play of the game; (b) may be the numbers generated by the RNG after the numbers which are used or employed for an actual play of the game; or (c) if no plays of the game of the gaming system are occurring, the unused numbers generated by the RNG at one or more points in time.

It should also be appreciated that the present disclosure contemplates that the display of one or more missed awards based on one or more unused RNG numbers or unemployed RNG numbers can be for plays of one or more primary or base wagering games, for plays of secondary or bonus wagering games (such a free spin games), or for plays of both. For example, in some embodiments, the system displays the award the player could have won had the player initiated a new game that started with that unemployed RNG number, where that award includes all payout components of that game including any bonus game outcomes that, in turn, would use the next unemployed RNG number.

It should be appreciated that the display of the missed awards provided by the present disclosure can be used with existing gaming systems or gaming devices that generate but do not use RNG numbers to determine actual outcomes of plays of games. It should further be appreciated that the existing display devices of such gaming systems or gaming devices can be used to display the missed awards, or that additional display devices can be used in association with the gaming system or gaming devices to display the missed awards. In various embodiments, the gaming system or gaming device displays the missed awards to the player separately or in a separate display from where the gaming system or gaming device displays any actual awards for plays of the game to the player to avoid any confusion of what awards are actually won by the player. In some embodiments, the gaming system displays actual awards in the same display area at which it displays the missed awards.

It should also be appreciated that that since the conventional commercially employed RNG generators tend to generate so many numbers per second, the present disclosure contemplates displaying indications of substantially less than all of the missed awards to make the indications of the missed awards more understandable to players. Thus, it should be appreciated that the missed award displays contemplated by the present disclosure may not display every missed award and may thus indicate to the player that not every missed award based on one or more unused RNG numbers are displayed. For example, if the RNG generator generates two thousand numbers per second, the gaming system may simply use one subset of these numbers every five seconds to display a missed award for those five seconds. It should be appreciated that any suitable rate of displaying awards can be employed in accordance with the present disclosure.

The present disclosure contemplates that a minimum missed award level may or may not be employed to determine which missed awards to display. For example, in certain embodiments of the present disclosure, the gaming system or gaming device only displays missed awards greater a designated award amount such as $20. In these embodiments, the designated award amount may be: (a) predetermined; (b) randomly determined; (c) determined based on a wager amount or level; (d) determined based on the denomination of the gaming system or gaming device; (e) determined based on the maximum wager amount; (f) determined based on whether the award is larger than some proportion of the wager, such as 100% of the wager or 50% of the wager; or (g) determined based on whether the award is larger than or equal to some proportion of the wager, such as 100% of the wager or 50% of the wager It should be appreciated that the designated award amount may be determined in any suitable manner.

It should also be appreciated that the missed awards can be determined by the gaming system or gaming device based on any suitable award wagering level for the gaming system or gaming device. In various embodiments, the gaming system or gaming device determines the missed awards based on the maximum wager allowed by the gaming system or gaming device. In various other embodiments, the gaming system or gaming device determines the missed awards based on the minimum wager allowed by the gaming system or gaming device. It should be appreciated that the present disclosure contemplates that the wager amount used to determine the missed award may or may not be displayed by the gaming system or gaming device. It should further be appreciated that the wager amount used to determine the missed award may need to be displayed or indicated to the player(s) to be considered a complete disclosure.

Likewise, it should be appreciated that the present disclosure contemplates that other explanatory information may need to be displayed, indicated, or otherwise provided to the player(s) for the indications of the missed awards, such as an indication of outcomes that correspond to a bonus award, to be considered complete or fair. For example, the gaming system may need to display one or more of the following information: (a) the percentage time period in which the missed awards could have been generated, (b) the average expected payback percentage, (c) the average bonus frequency, and/or (d) any other suitable information. In certain embodiments, where actual awards are also displayed in same area as missed awards, a designation between actual versus missed awards is designated by the display.

The present disclosure contemplates that, in addition to displaying missed awards based on one or more unused RNG numbers, the gaming system or gaming device can display: (1) missed awards that would have brought an even pay to the player (i.e., where the player would have won back what the player wagered); (2) missed awards that would have brought a pay smaller than the wager to the player (i.e., where the player would have won back only a fraction of what the player wagered); (3) missed losses determined based on one or more unused RNG numbers which shows the amount of the wager lost; or (4) any combination of these. It should be appreciated that the determination and display of even pay missed awards and missed losses is based on a designated wager amount which the gaming system or gaming device may also display.

The present disclosure contemplates that the gaming system may determine the missed awards in any of a variety of different suitable manners. In certain embodiments, the gaming system determines awards based on each of the unused numbers generated by the RNG and then determines which of these awards to display using the missed award display.

In certain other embodiments, the gaming system determines awards based on selected unused sets of numbers generated by the RNG and then determines which of these awards to display using the missed award display. It should be appreciated that each of the unused sets of numbers includes at least one unused number. It should also be appreciated that one or more of the unused sets of numbers may include one or more used numbers in addition to any unused numbers. Put differently, as long as a set of numbers includes at least one unused number, that set of numbers is an unused set of numbers because at least one of the numbers in that set was not used to determine a player's actual outcome (i.e., the player's actual award) for a play of a game. It should be appreciated that the unused sets of numbers can be selected in any suitable manner. In certain embodiments, the unused sets of numbers are themselves selected randomly to avoid players watching for patterns in the missed awards and trying to time when to play the game. In other embodiments, the unused sets of numbers are selected at predetermined time intervals.

In certain embodiments, when the gaming system selects an unused set of numbers, the gaming system determines, without displaying any symbols on any reels, which symbols would have occurred on the reels had the unused set of numbers been used to determine an outcome for a play of a game. The gaming system then determines a missed award that corresponds to that determined outcome, and displays the missed award. It should be appreciated that in certain embodiments the gaming system displays a subset of any determined missed awards and not each determined missed award.

The present disclosure contemplates adding such functionality to an existing gaming system via a peripheral. Specifically, an existing gaming system may be modified to send the used and unused numbers to a processor, which selects an unused set of those received numbers, determines the missed award, and causes the display device of the gaming system or a separate display device to display the missed award.

Figure 3:
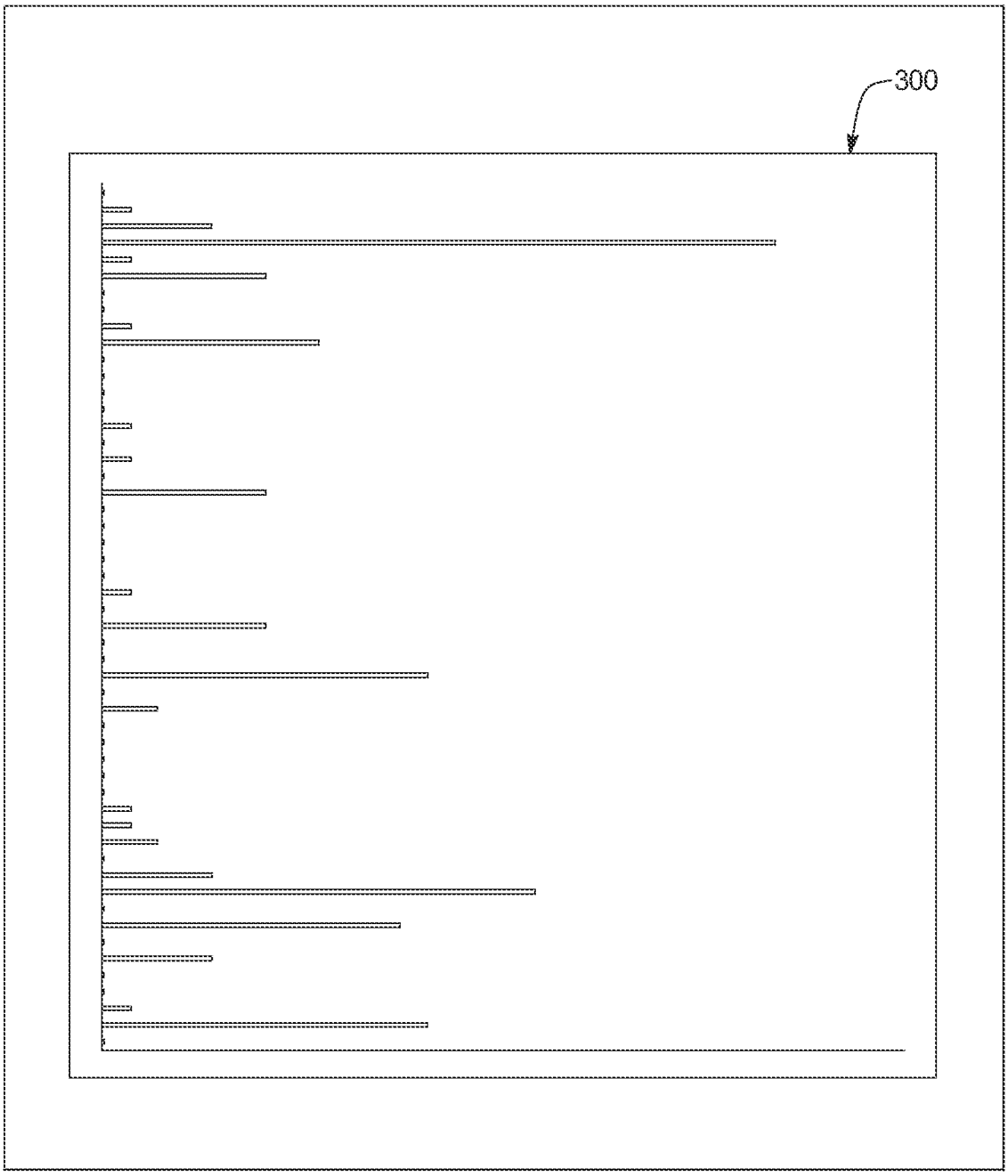
FIG. 3 is a front view of a display of one example embodiment of a gaming system of the present disclosure, wherein the display indicates missed awards based on one or more unused numbers generated by a random number generator.

Turning now to FIG. 3, one example embodiment of the missed award display provided by the present disclosure is generally shown. In this example embodiment, the missed award display 300 uses a bar graph to show a general indication of the size of a plurality of missed awards based on one or more unused RNG numbers without showing the actual amounts of the missed awards. It should be appreciated that in some embodiments the actual amounts of the missed awards are explicitly indicated, implicitly indicated, or indicated via a ranking.

Figure 4:
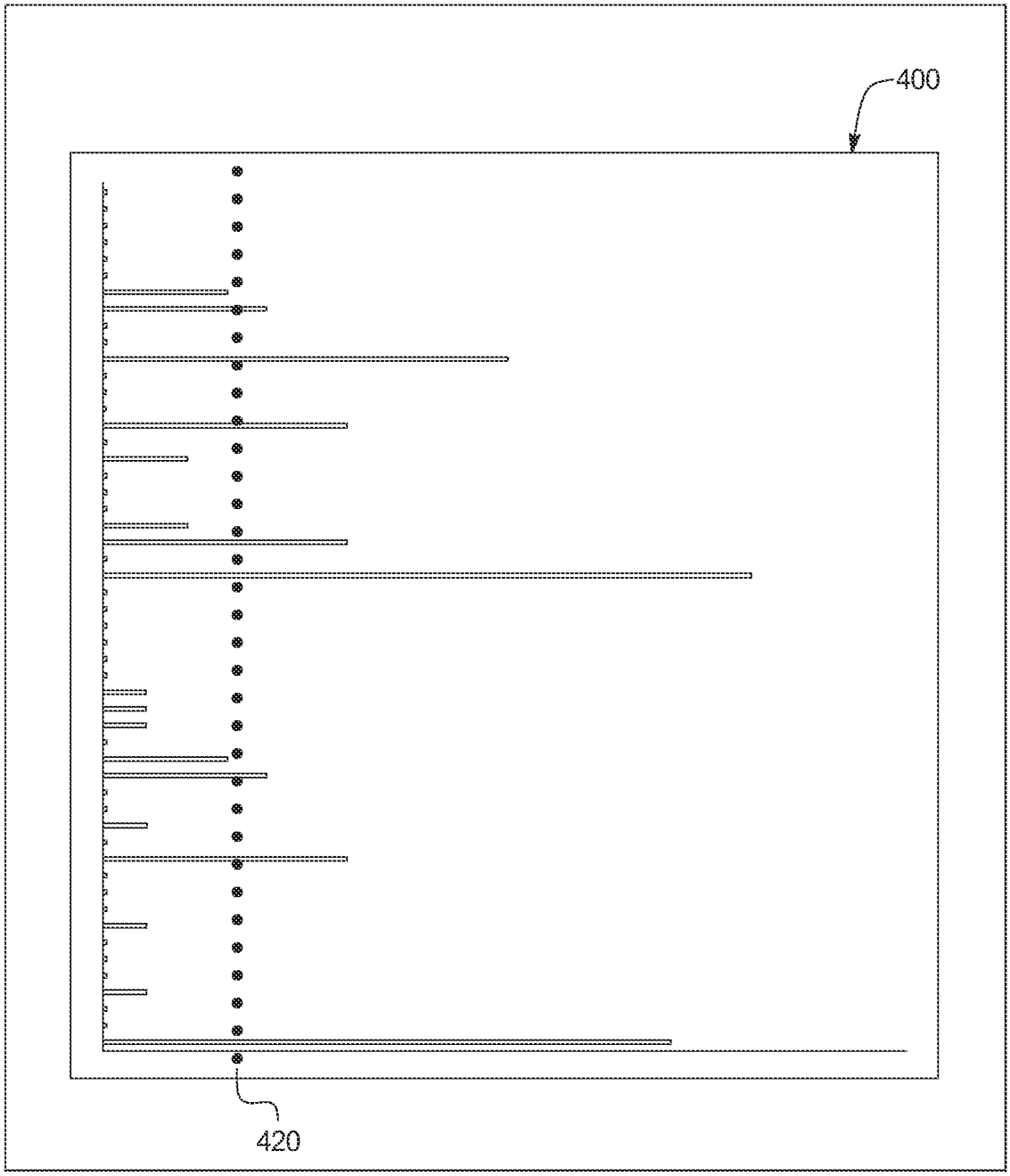
FIG. 4 is a front view of a display of another example embodiment of a gaming system of the present disclosure, wherein the display indicates a wager level and missed awards based on one or more unused numbers generated by a random number generator.

Turning now to FIG. 4, another alternative example embodiment of the missed award display provided by the present disclosure is generally shown. In this example embodiment, the missed award display 400 uses a bar graph to show a general indication of the size of a plurality of missed awards based on one or more unused RNG numbers without showing the actual amounts of the missed awards. This missed award display also displays an indication of the missed awards relative to a designated wager amount or level indicated by the vertical line of dots. It should be appreciated that in some embodiments the actual amounts of the missed awards are explicitly indicated, implicitly indicated, or indicated via a ranking.

Figure 5:
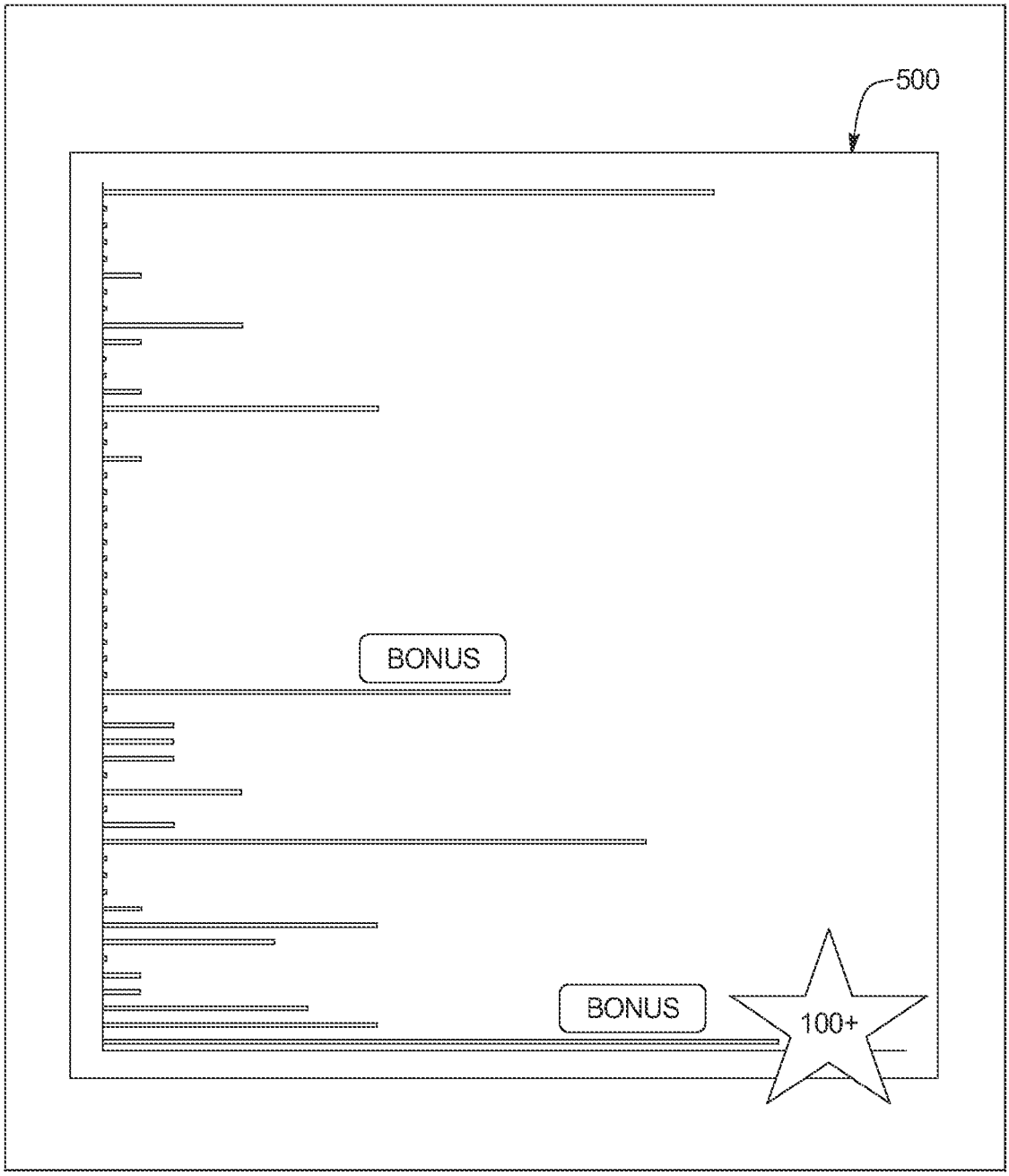
FIG. 5 is a front view of a display of another example embodiment of a gaming system of the present disclosure, wherein the display indicates missed awards including missed bonus opportunities or bonus awards based on one or more unused numbers generated by a random number generator.

Turning now to FIG. 5, another alternative example embodiment of the missed award display provided by the present disclosure is generally shown. In this example embodiment, the missed award display 500 uses a bar graph to show a general indication of the size of a plurality of missed awards including an indication of missed bonus games which could have occurred based on one or more unused RNG numbers without showing the actual amounts of the missed awards. In this example embodiment, the missed award display 500 shows when a bonus game would have been triggered based on one or more unused RNG numbers, and that an award of at least 100 would have been won in the second bonus game. It should be appreciated that in some embodiments the actual amounts of the missed awards are explicitly indicated, implicitly indicated, or indicated via a ranking.

Figure 6:
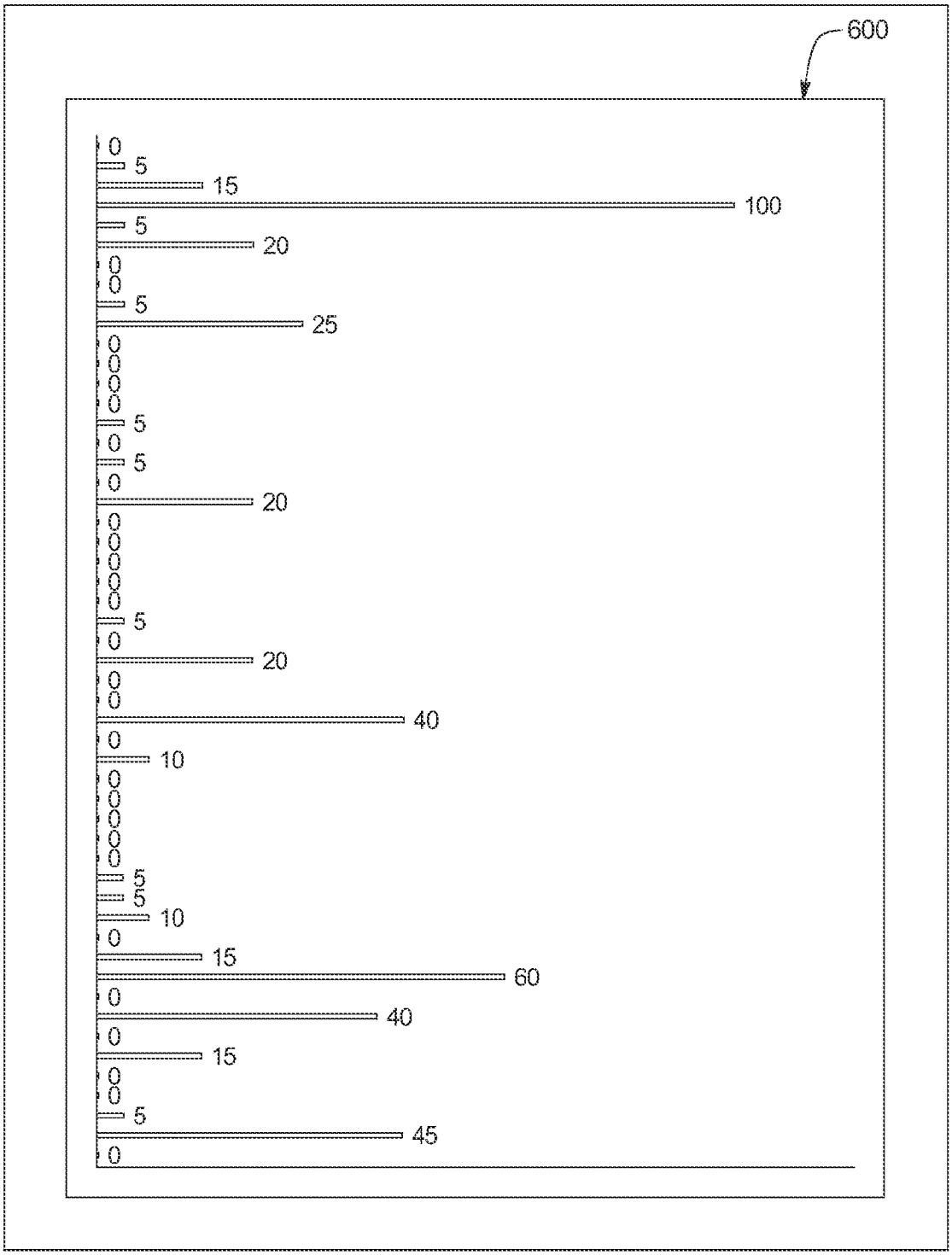
FIG. 6 is a front view of a display of another example embodiment of a gaming system of the present disclosure, wherein the display indicates missed awards based on one or more unused numbers generated by a random number generator.

Turning now to FIG. 6, another alternative example embodiment of the missed award display provided by the present disclosure is generally shown. In this example embodiment, the missed award display 600 uses a bar graph which shows a specific indication of the amount of each of a plurality of missed awards based on one or more unused RNG numbers. In this example, assuming a five credit wager, even missed awards (e.g., awards of five credits) and missed losses (e.g., awards of zero credits) are also shown.

Figure 7:
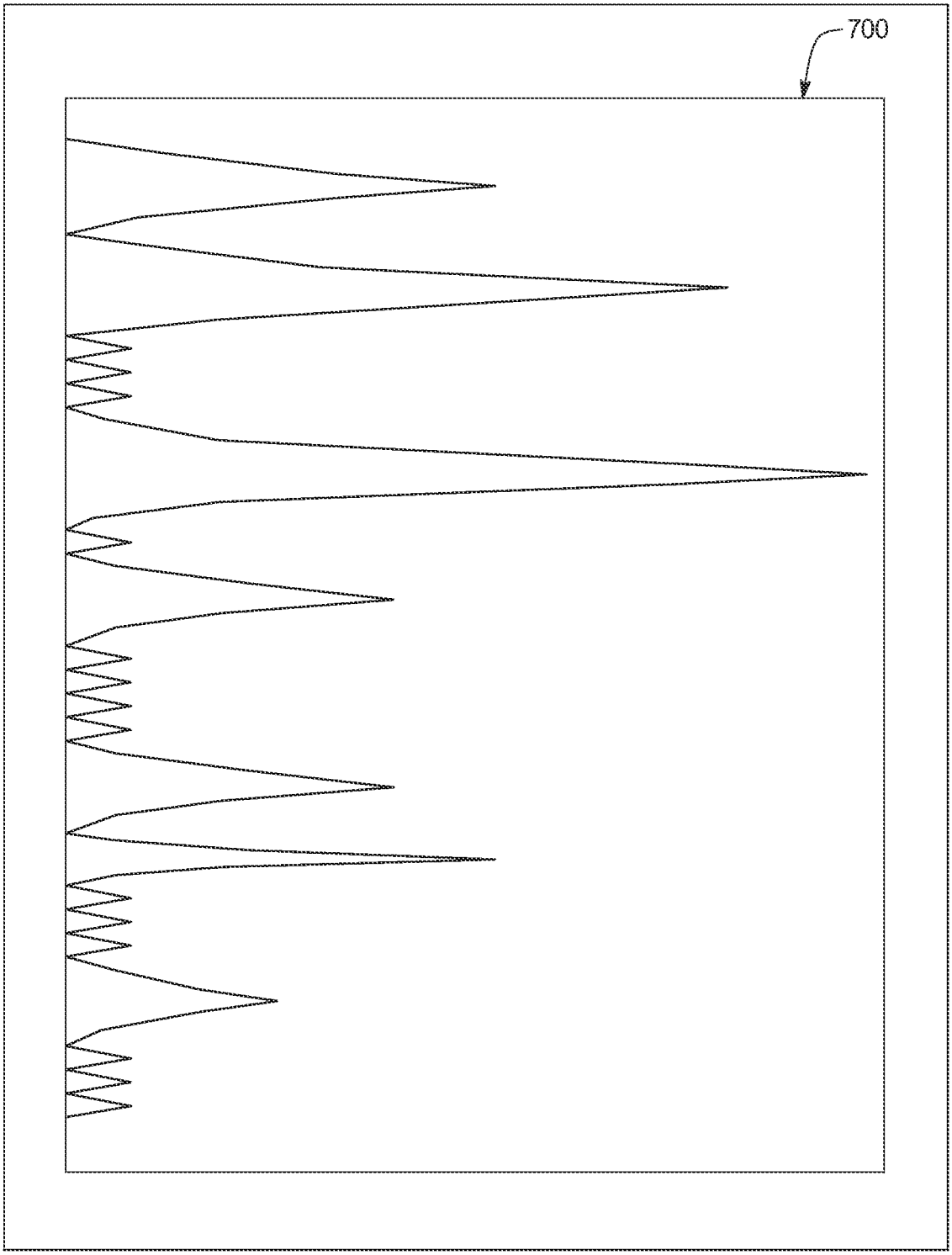
FIG. 7 is a front view of a display of another example embodiment of a gaming system of the present disclosure, wherein the display indicates missed awards based on one or more unused numbers generated by a random number generator.

Turning now to FIG. 7, another alternative example embodiment of the missed award display provided by the present disclosure is generally shown. In this example embodiment, the missed award display 700 uses a line graph to generally show an indication of a plurality of missed awards based on one or more unused RNG numbers without showing the actual amounts of the missed awards. In this example, even missed awards are also shown on the left side of the missed award display. It should be appreciated that in some embodiments the actual amounts of the missed awards are explicitly indicated, implicitly indicated, or indicated via a ranking.

Figure 8:
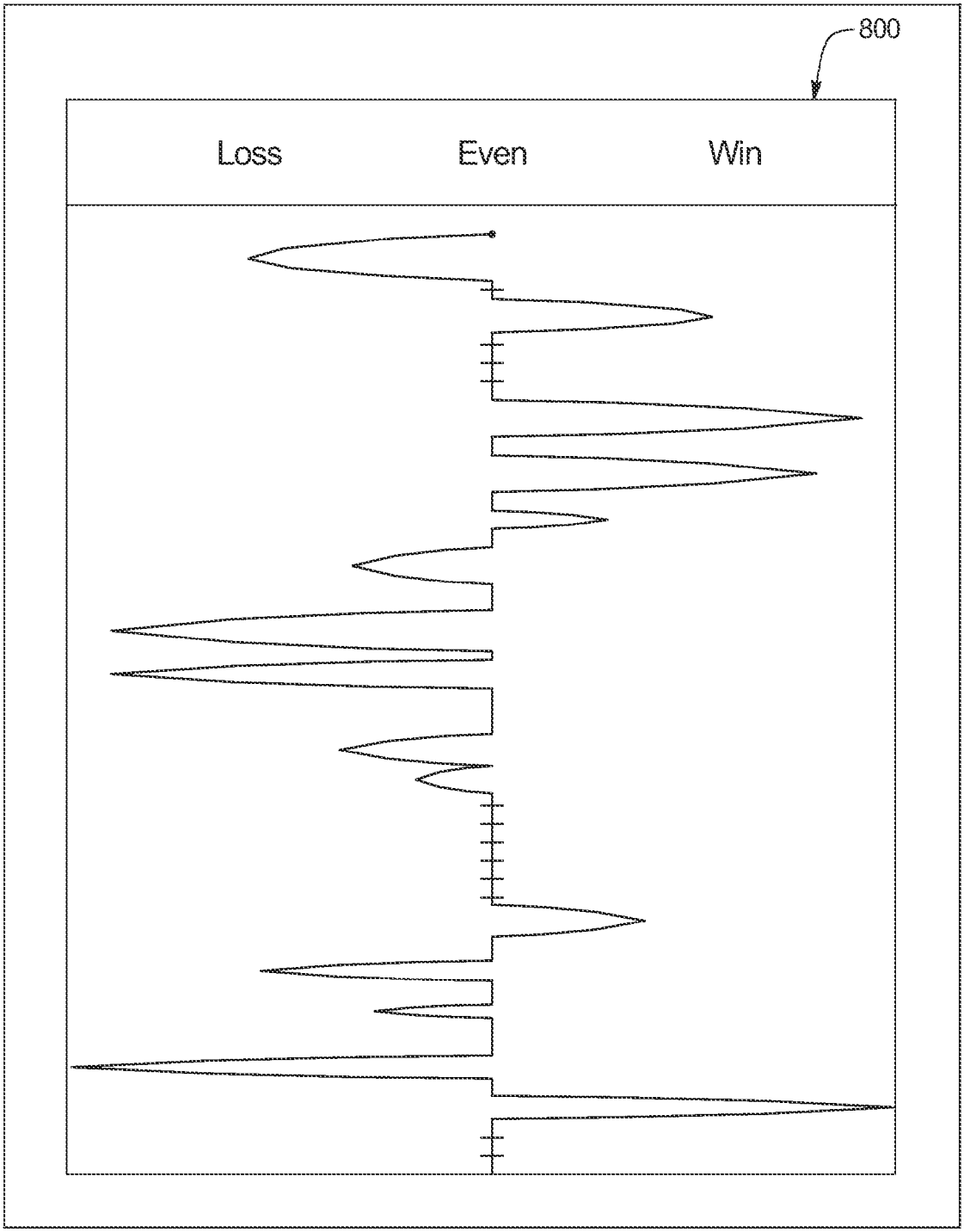
FIG. 8 is a front view of a display of another example embodiment of a gaming system of the present disclosure, wherein the display indicates missed awards based on one or more unused numbers generated by a random number generator.

Turning now to FIG. 8, another alternative example embodiment of the missed award display provided by the present disclosure is generally shown. In this example embodiment, the missed award display 800 uses a line graph to generally show an indication of a plurality of missed awards based on one or more unused RNG numbers without showing the actual amounts of the missed awards. In this example, the even awards are shown on the middle of the missed award display, the missed losses are shown on the left side of the missed award display, and the missed awards greater than the even awards are shown on the right side of the missed award display. It should be appreciated that in some embodiments the actual amounts of the missed awards are explicitly indicated, implicitly indicated, or indicated via a ranking.

Figure 9:
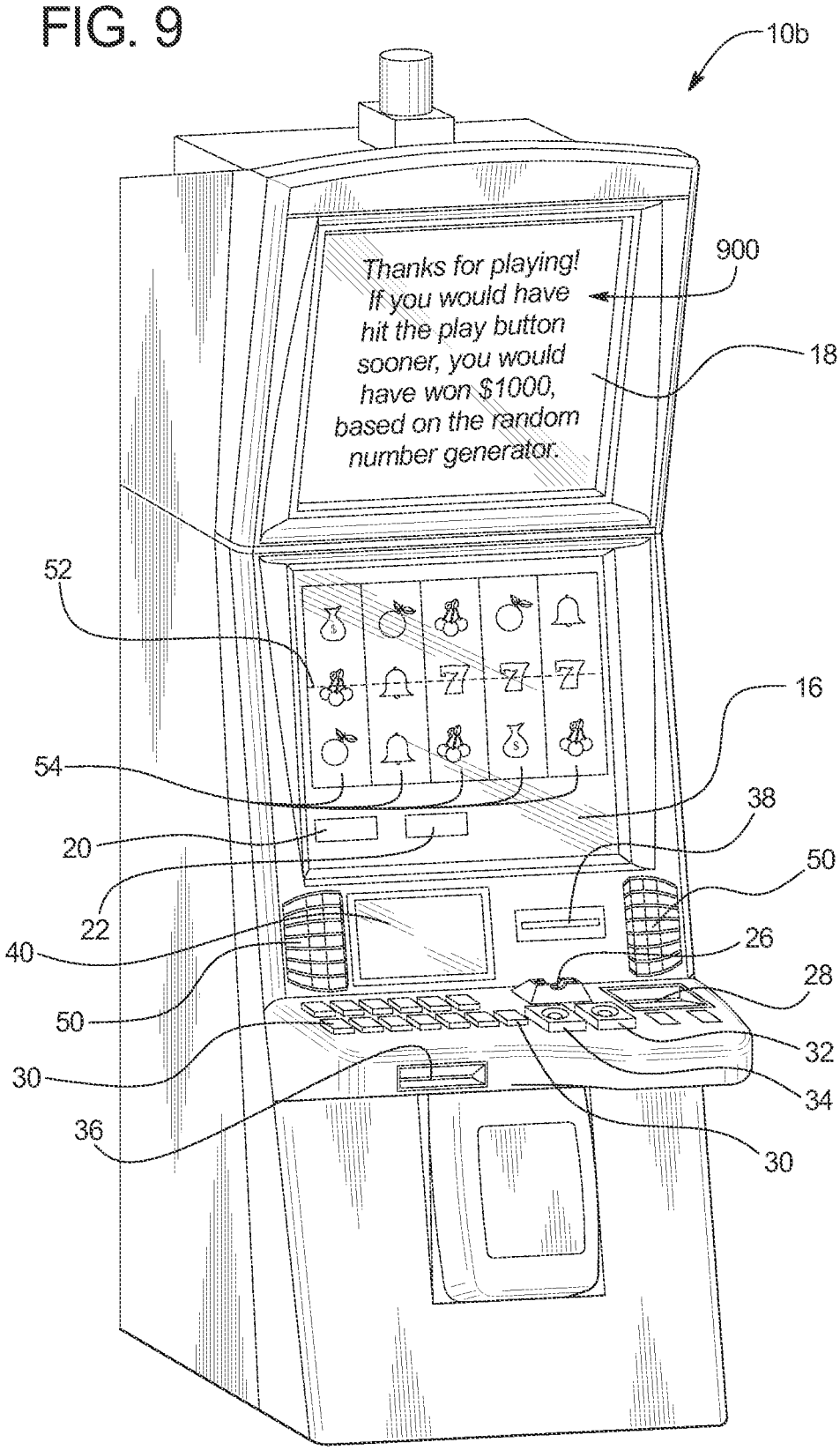
FIG. 9 is a front view of another example embodiment of a gaming system of the present disclosure, wherein the display indicates a missed award based on one or more unused numbers generated by a random number generator.

Turning now to FIG. 9, another alternative example embodiment of the missed award display provided by the present disclosure is generally shown. In this example embodiment, the gaming device 10*a* is employed and the upper display of the gaming device 10*a* is used as the missed award display 900 to display or indicate a missed award of $1000 based on one or more unused numbers generated by the random number generator prior to the numbers used to generate the outcome for the play of the game.

Figure 10:
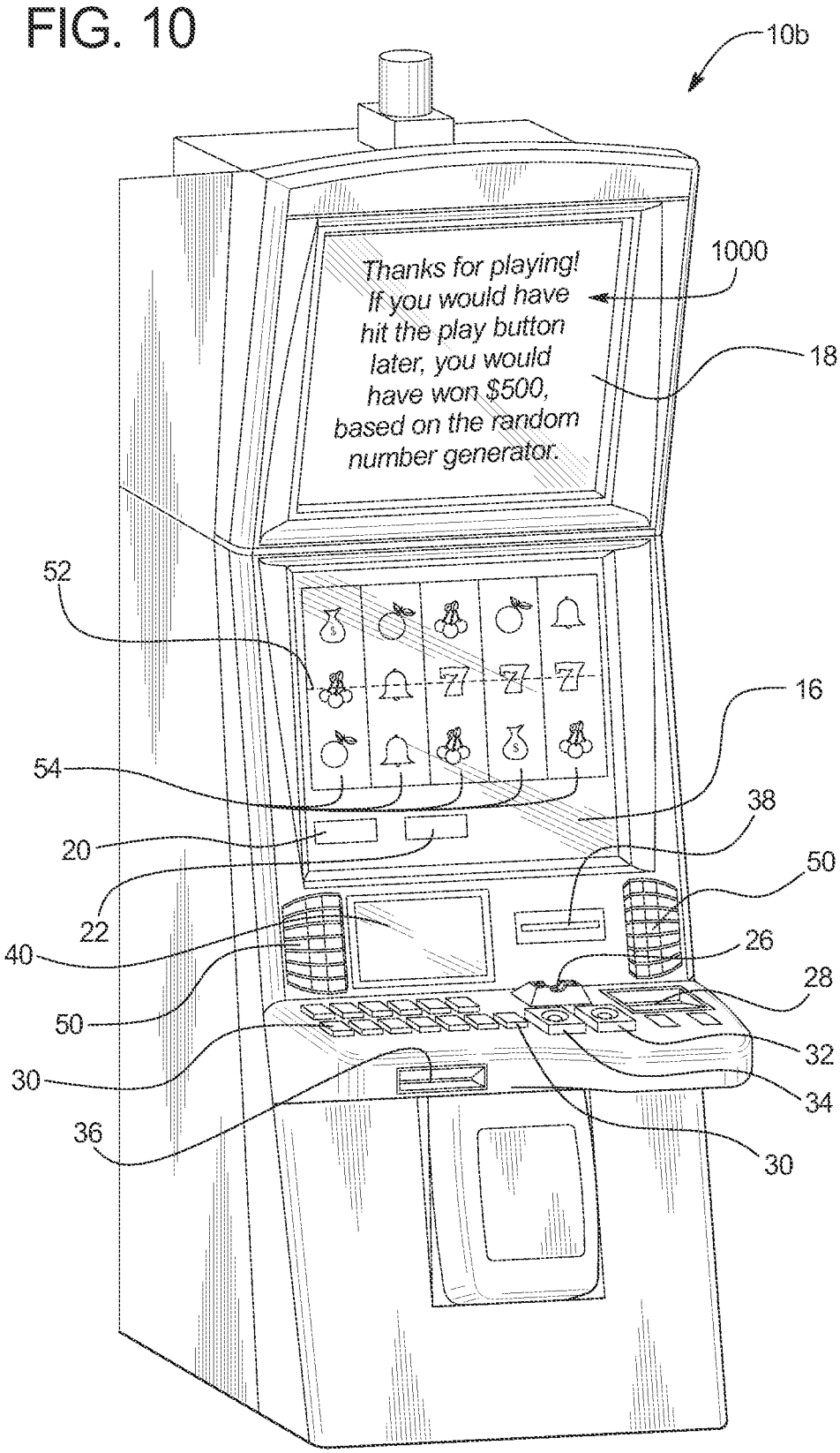
FIG. 10 is a front view of another example embodiment of a gaming system of the present disclosure, wherein the display indicates a missed award based on one or more unused numbers generated by a random number generator.

Turning now to FIG. 10, another alternative example embodiment of the missed award display provided by the present disclosure is generally shown. In this example embodiment, the gaming device 10*a* is employed and the upper display of the gaming device 10*a* is used as the missed award display 1000 to display or indicate a missed award of $500 based on one or more unused numbers generated by the random number generator after the numbers used to generate the outcome for the play of the game.

Figure 11:
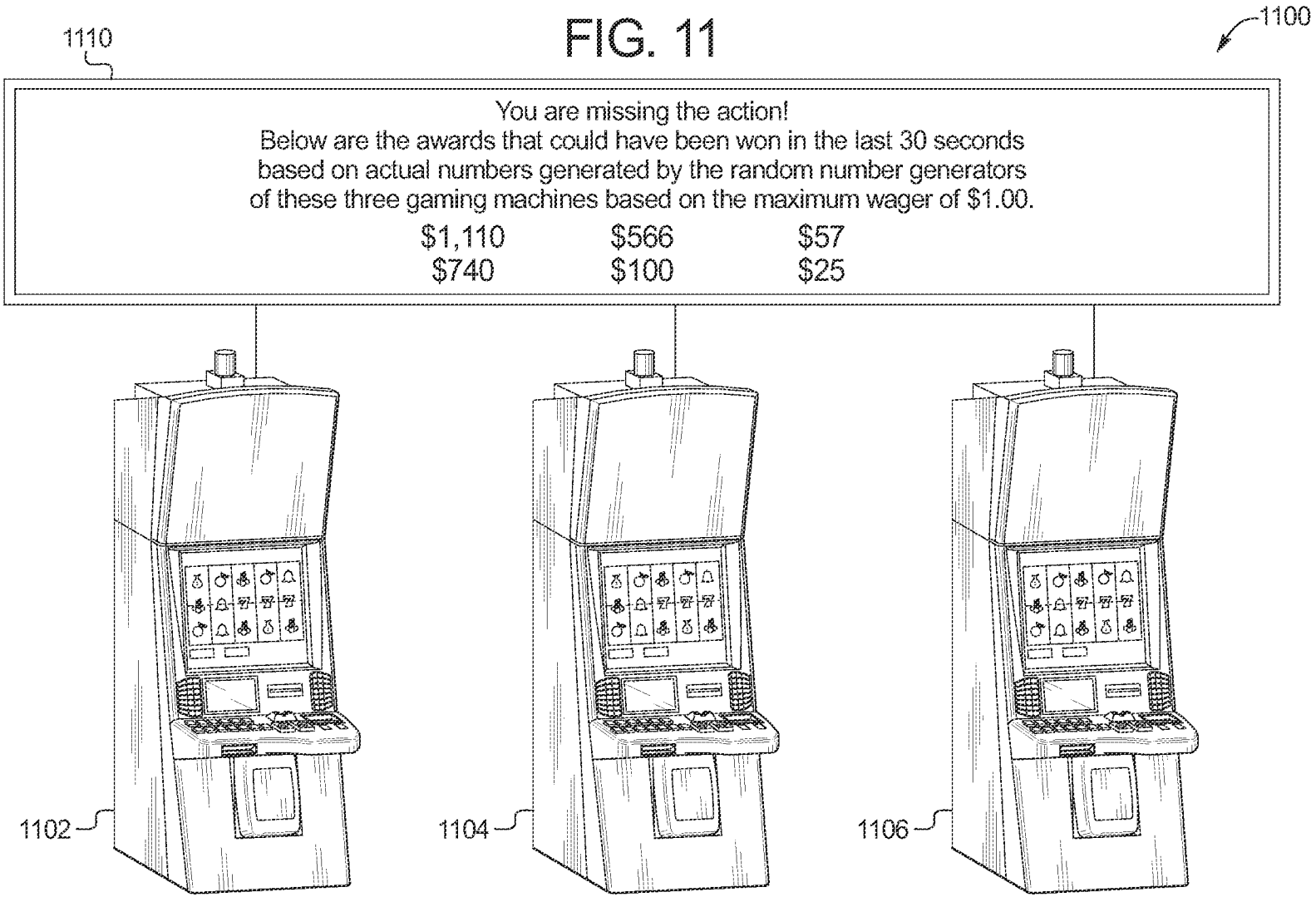
FIG. 11 is a front view of another example embodiment of a gaming system of the present disclosure which includes three gaming devices and a missed award display device above these gaming devices, wherein the missed award display device indicates missed awards based on one or more unused numbers generated by a random number generator within a designated time period.

Turning now to FIG. 11, another alternative example embodiment of the missed award display provided by the present disclosure is generally shown. In this example embodiment, the gaming system 1100 includes three gaming devices 1102, 1104, and 1106 and a missed award display device 1110 positioned above these gaming devices, wherein the missed award display device 1110 indicates a plurality of missed awards based on one or more unused numbers generated by a random number generator within a designated time period of 30 seconds prior to the display and based on a maximum wager of $1.00.

It should be appreciated from this example in FIG. 11 that the present disclosure contemplates a gaming system or gaming device displaying missed awards based on one or more unused RNG numbers when the gaming system or gaming device is not being played by any players. By being able to see one, a plurality, or all of the missed awards based on one or more unused RNG numbers, certain players may be more likely to play the gaming system or gaming device.

As described above, it should be appreciated that, for a given missed award, that missed award may be based on either: (a) one or more unused RNG numbers, or (b) one or more unused RNG numbers and one or more used RNG numbers. In other words, as long as an award is based on at least one unused RNG number, that award is a missed award.

In certain embodiments, the display provided by the gaming system, gaming device, and method of the present disclosure essentially informs the player that if the player would have activated the play button at a different time (such as right before or right after the player did so), the player could have won the displayed award. In other embodiments, the display informs the player of one or more awards that would have been won if the player activated the play button respectively at one or more points in time. It should be appreciated that the present disclosure contemplates that multiple different displays can be employed for representing missed awards based on one or more unused RNG numbers.

In various embodiments, the gaming system or gaming device displays more than one missed award. In various embodiments, the gaming system or gaming devices displays: (a) one missed award after one or more designated plays of the game; (b) one missed award after each play of the game; (c) multiple missed awards after each designated play of the game; or (d) multiple missed awards after each play of the game.

It should be appreciated that in certain alternative embodiments of the present disclosure, the RNG can be configured to slow down the process of generating RNG numbers if no player is playing the gaming system or gaming device, and in such case any such displays of missed awards would be based on such RNG numbers.

In various other embodiments, the display based on the one or more unused RNG numbers can be: (a) a suitable indication or representation of certain unused RNG numbers; (b) a suitable indication or representation of the potential value of certain unused RNG numbers; (c) a display of one or more symbols which would have been generated in the play of the game based on certain unused RNG numbers; or (d) a display of one or more outcomes (i.e., groups of symbols) which would have been generated in the play of the game based on certain unused RNG numbers. In such alternative embodiments, it should be appreciated that the present disclosure contemplates that multitude different displays can be employed for the potential values of the unused RNG numbers, the symbols based on these unused RNG numbers, the outcomes or groups of symbols based on these unused RNG numbers, and the awards based on these unused RNG numbers.

In certain embodiments, the gaming system disables the missed awards display (i.e., does not display any missed awards) while the player is in a bonus round or otherwise playing a bonus or secondary game. In various embodiments, upon completion of the bonus round, the gaming system: (a) begins displaying new missed awards where the missed awards display left off (i.e., does not display any missed awards determined during play of the bonus round or the bonus or secondary game); (b) clears (i.e., resets) the missed awards display and begins displaying missed awards anew; or (c) displays any missed awards determined during play of the bonus round or the bonus or secondary game.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

at least one input device;

at least one display device;

at least one processor; and and at least one memory device which stores a plurality of instructions, which when executed by the at least one processor, cause the at least one processor to operate with the at least one input device and the at least one display device to:

after a player activates a play of a game at a specific point in time, cause a first display of any awards generated for the play of the game; and cause a second display of a missed award that would have been generated for said play of the game if the player activated said play of the game at a different point in time prior to or after the specific point in time that the player activated said play of the game.

2. The gaming system of claim 1, wherein the different point in time is prior to the specific point in time when the player activated the play of the game.

3. The gaming system of claim 1, wherein the different point in time is after the specific point in time when the player activated a play button at the at least one input device for the play of the game.

4. The gaming system of claim 1, wherein each award and each missed award has a value greater than or equal to zero.

5. A gaming system comprising:

at least one input device;

at least one display device;

at least one processor; and at least one memory device which stores a plurality of instructions, which when executed by the at least one processor, cause the at least one processor to operate with the at least one input device and the at least one display device, for a play of a game, to:

(a) when a player activates a play button of the at least one input device for the play of the game, use a first designated quantity of numbers from a series of numbers generated by one of a pseudo-random number generator and a random number generator to determine an outcome of the play of the game;

(b) display the outcome of the play of the game;

(c) determine and display any awards associated with the outcome of the play of the game;

(d) provide said awards to the player;

(e) use a second designated quantity of the numbers from the series of numbers generated by one of the pseudo-random number generator and the random number generator to determine an alternative outcome for the same play of the game; and (f) determine and display any missed awards associated with said alternative outcome for the same play of the game, without providing any of said awards associated with said alternative outcome to the player.

6. The gaming system of claim 5, wherein the plurality of instructions, when executed by the at least one processor, cause the at least one processor to operate with the at least one display device to display an indication to the player that the player would have won the missed awards associated with said alternative outcome if the player would have activated the play button of the at least one input device for the player of the game prior to when the player activated the play button for the play of the game.

7. The gaming system of claim 5, wherein the plurality of instructions, when executed by the at least one processor, cause the at least one processor to operate with the at least one display device to display an indication to the player that the player would have won the awards associated with said alternative outcome if the player would have activated the play button of the at least one input device for the play of the game after when the player activated the play button for the play of the game.

8. The gaming system of claim 5, wherein any awards and any missed awards each has a value greater than or equal to zero.

9. The gaming system of claim 5, wherein the first designated quantity of numbers and the second designated quantity of numbers are different.

10. A gaming system comprising:

at least one input device;

at least one display device;

at least one processor; and at least one memory device which stores a plurality of instructions, which when executed by the at least one processor, cause the at least one processor to operate with the at least one input device and the at least one display device to:

(a) use a designated quantity of a plurality of numbers generated by one of a pseudo-random number generator and a random number generator to determine a randomly generated outcome for a play of a game;

(b) display said outcome for the play of the game and any awards associated with said outcome; and (c) cause an additional display based one or more of the plurality of numbers generated by one of the pseudo-random number generator and the random number generator for possible use in determining the randomly generated outcome for the play of the game, but at least one of which is not used to determine the randomly generated outcome for the play of the game.

11. The gaming system of claim 10, wherein said additional display indicates that the player could have won, but did not win, a missed award.

12. The gaming system of claim 11, wherein any awards and any missed awards each has a value greater than or equal to zero.

13. The gaming system of claim 10, wherein for the play of the game, the numbers which are not used to determine the randomly generated outcome for the play of the game are numbers generated by the random number before the numbers which are used to determine the randomly generated outcome for the play of the game.

14. The gaming system of claim 10, wherein for the play of the game, the numbers which are not used to determine the randomly generated outcome for the play of the game are numbers generated by the random number after the numbers which are used to determine the randomly generated outcome for the play of the game.

15. The gaming system of claim 10, wherein the additional display is selected from the group consisting of: (a) a representation of the unused RNG numbers; (b) a representation the potential value the unused RNG numbers; (c) one or more symbols which would have been generated in the play of the game based on the unused RNG numbers; (d) one or more outcomes which would have been generated in the play of the game based on the unused RNG numbers; and (e) a display of an award which would have been generated in the play of the game based on the unused RNG numbers.

16. The gaming system of claim 10, wherein the additional display is selected from the group consisting of: (a) one missed award after one or more designated plays of the game; (b) one missed award after each play of the game; (c) multiple missed awards after each designated play of the game; and (d) multiple missed awards after each play of the game.

17. A gaming system comprising:

at least one input device;

at least one display device;

at least one processor; and at least one memory device which stores a plurality of instructions, which when executed by the at least one processor, cause the at least one processor to operate with the at least one input device and the at least one display device to:

(a) cause one of a pseudo-random number generator and a random number generator to generate a plurality of numbers;

(b) calculate at least one award which could have been won by a player, but which was not won by any player, each said award based on at least one unused number generated by one of the pseudo-random number generator and the random number generator; and (c) display each award with an indication that said award could have been won.

18. The gaming system of claim 17, wherein each award is displayed when the gaming system is not being played by any player.

19. The gaming system of claim 17, wherein each award has a value greater than or equal to zero.

20. The gaming system of claim 17, wherein a number generated by one of the pseudo-random number generator and the random number generator that is not used to determine at least one award won by a player is an unused number.

* * * * *

UNITED STATES PATENT AND TRADEMARK OFFICE

CERTIFICATE OF CORRECTION

PATENT NO. : 8,784,183 B2
APPLICATION NO. : 13/246422
DATED : July 22, 2014
INVENTOR(S) : Mark C. Nicely It is certified that error appears in the above-identified patent and that said Letters Patent is hereby corrected as shown below:

IN THE CLAIMS

In Claim 5, Column 28, Line 31, delete “the”.
In Claim 7, Column 28, Line 53, between “the” and “awards” insert --missed--.
In Claim 10, Column 29, Line 12, between “based” and “one” insert --on--.
In Claim 11, Column 29, Line 20, replace “the” with --a--.
In Claim 13, Column 29, Line 28, between “number” and “before” insert --generator--.
In Claim 14, Column 29, Line 34, between “number” and “after” insert --generator--.
In Claim 15, Column 29, Line 40, before the first instance of “the” insert --of--.
In Claim 15, Column 29, Line 40, between “value” and the second instance of “the” insert --of--.

Signed and Sealed this
Twenty-eighth Day of July, 2015

Michelle K. Lee

Michelle K. Lee
*Director of the United States Patent and Trademark Office*